US010113251B2

(12) United States Patent
Kovacs et al.

(10) Patent No.: US 10,113,251 B2
(45) Date of Patent: Oct. 30, 2018

(54) SLIVER GUIDE FOR A DRAWING FRAME, AND A DRAWING FRAME WITH THE SILVER GUIDE

(71) Applicant: Rieter Ingoldtadt GmbH, Ingolstadt (DE)

(72) Inventors: Otmar Kovacs, Berching (DE); Juergen Mueller, Ingolstadt (DE); Imadettin Karalar, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 41 days.

(21) Appl. No.: 15/126,826

(22) PCT Filed: Mar. 16, 2015

(86) PCT No.: PCT/EP2015/055391

§ 371 (c)(1),
(2) Date: Sep. 16, 2016

(87) PCT Pub. No.: WO2015/140087

PCT Pub. Date: Sep. 24, 2015

(65) Prior Publication Data

US 2017/0088978 A1 Mar. 30, 2017

(30) Foreign Application Priority Data

Mar. 17, 2014 (DE) ..... 10 2014 103 598

(51) Int. Cl.
*D01H 5/00* (2006.01)
*D01G 15/64* (2006.01)

(52) U.S. Cl.
CPC ..... *D01H 5/005* (2013.01); *D01G 15/64* (2013.01)

(58) Field of Classification Search
CPC ..... D01H 5/005; D01G 15/64; D01G 15/10; D01G 1/06; D01G 5/00
See application file for complete search history.

(56) References Cited

U.S. PATENT DOCUMENTS 2,357,982 A * 9/1944 Thomas ..... D01G 15/64 19/150
3,216,064 A 11/1965 Kates, Jr.
(Continued)

FOREIGN PATENT DOCUMENTS

DE 41 42 038 A1 6/1993
DE 198 53 192 A1 6/1999
(Continued)

OTHER PUBLICATIONS

German Patent Office Search Report, dated Feb. 6, 2015.
PCT Search Report, dated May 22, 2015.

*Primary Examiner* — Shaun R Hurley
*Assistant Examiner* — Andrew W Sutton
(74) *Attorney, Agent, or Firm* — Dority & Manning, P.A.

(57) ABSTRACT

A sliver guide for guiding a plurality of textile slivers in an entry region of a drawing frame, includes a first guide portion for guiding a first group of textile slivers, and a second guide portion for separately guiding a second group of textile slivers. In a side view of the sliver guide, the first guide portion and the second guide portion are spaced apart from one another. The sliver guide has a third guide portion spaced apart from the first guide portion and from the second guide portion. To at least one of the guide portions, lateral guide elements for laterally guiding textile slivers are assigned, wherein the mutual distance of the guide elements can be adjusted.

13 Claims, 7 Drawing Sheets

(56) References Cited

U.S. PATENT DOCUMENTS

| | | | | |
|---|---|---|---|---|
| 5,311,731 | A * | 5/1994 | Stahlecker | D01H 5/005 57/315 |
| 5,343,598 | A | 9/1994 | Hauner | |
| 6,021,548 | A | 2/2000 | Temburg | |
| 7,310,856 | B2 | 12/2007 | Temburg | |

FOREIGN PATENT DOCUMENTS

| | | | |
|---|---|---|---|
| DE | 103 47 811 | A1 | 6/2005 |
| GB | 06823 | A | 3/1911 |
| JP | H 04 108120 | A | 4/1992 |

* cited by examiner

SLIVER GUIDE FOR A DRAWING FRAME, AND A DRAWING FRAME WITH THE SILVER GUIDE

FIELD OF THE INVENTION

The present invention relates to a sliver guide for guiding a multiple number of fiber slivers in an entrance area of a draw frame, with a first guide section for guiding a first group of fiber slivers, and a second guide section for the separate guidance of a second group of fiber slivers. In a side view of the sliver guide, the first guide section and the second guide section are spaced apart from each other. In addition, a draw frame with at least one entrance area for fiber slivers to be drafted, and with at least one drafting unit, with a multiple number of drafting unit rollers is proposed. In the entrance area, a first guide section is arranged for guiding a first group of fiber slivers, and a second guide section for the separate guidance of a second group of fiber slivers is arranged. The first guide section and the second guide section are, in a side view of the draw frame, spaced apart from each other.

BACKGROUND

Draw frames are mainly used to produce a fiber web that is as uniform as possible from a multiple number of fiber slivers. For this purpose, the draw frame has one or more drafting units, which in turn comprise a series of drafting elements, typically in the form of several successively arranged pairs of rollers, whereas the fiber slivers are guided between the respective pairs of rollers by clamping. Since the pairs of rollers feature peripheral speeds that vary and increase in the running direction of the sliver, the fiber slivers are finally drafted and thereby made uniform.

With known draw frames, it is generally the case that a sliver guide is placed in the entrance area, i.e. in the area in which the fiber slivers run into the drafting unit; this comprises, for example, a multiple number of vertically extending rods, between which the individual fiber slivers are guided.

If the individual fiber slivers feature different qualities (such as different thicknesses or fiber lengths), the fiber web leaving the draw frame also usually features a quality fluctuating over its width, since the mixing of the fiber slivers is only limited within the draw frame.

SUMMARY

As such, a task of the present invention is to propose a sliver guide or a draw frame that enables the production of a fiber web even upon the drafting of fiber slivers of varying quality, which fiber web is characterized by a high degree of homogeneity. Additional objects and advantages of the invention will be set forth in part in the following description, or may be obvious from the description, or may be learned through practice of the invention.

The tasks are solved by a sliver guide and a drafting unit with the characteristics described and claimed herein.

In accordance with the invention, the sliver guide features, in addition to a first and a second guide section, a third guide section which, in a side view, is spaced apart from the first and second guide sections, whereas lateral guide elements are allocated to at least one of the guide sections for the lateral guidance of fiber slivers. The mutual distance of the guide elements is adjustable. Herein, the first guide section serves the purpose of the guidance of a first group of fiber slivers, and the second guide section serves the purpose of the guidance of a second group of fiber slivers. Finally, the third guide section preferably serves the purpose of the guidance of fiber slivers fed to the drafting unit, after passing through the first and the second guide sections. In other words, the sliver guide is designed to initially bring about a separation of the fed fiber slivers into two groups, which are separately guided by the two initially specified guide sections, whereas the fiber slivers are once again united after passing through such guide sections and are guided through the third guide section in front of the entrance of the drafting unit. Through the lateral guidance, there can be a final determination of how close to each other the individual fiber slivers pass through the respective guide sections.

Here, it would be advantageous, for example, if the mutual distance of the two guide elements of the third guide section is adjusted to be only slightly larger or smaller than the mutual distance of the guide elements of the first and/or second guide section. In this case, after passing through the first and second guide sections, an overlap of the individual fiber slivers in the area of the third guide section inevitably arises, such that the fiber slivers are overlaid already in front of the entrance to the drafting unit and, thereby, a type of mixing of the individual fiber slivers already takes place. In particular, a particularly uniform distribution of the individual fibers of the fiber slivers fed to the drafting unit (the thickness and/or composition of which may vary) finally arises in the drafted fiber assembly, and thus also in the yarn produced from the fiber assembly in a further step. Further, the adjustment of the specified distance permits a simple option of adjusting the sliver guide to different fiber slivers or different numbers of fiber slivers, whereas, in particular, the distance of the guide elements of the third guide section is to be chosen such that its amount is smaller than the total width of all of the fiber slivers. Thereby, it is ultimately ensured that some superimposing or overlapping of the fiber slivers, and thus the desired mixing of the individual fiber slivers, will arise.

It is advantageous if the sliver guide features a fourth guide section that, in the specified side view, is spaced apart from the first, the second and the third guide sections, whereas lateral guide elements are likewise preferably allocated to the fourth guide section for the lateral guidance of fiber slivers; the mutual distance of the guide elements is preferably adjustable. The fourth guide section is preferably arranged on the side of the second and/or third guide section facing away from the first guide section. Preferably, the fourth guide section serves the purpose of the guidance of all of the fiber slivers fed to the sliver guide, before they reach the area of the first and the second guide sections, in which they are divided between the specified two groups. Preferably, in a side view of the sliver guide, the specified guide sections are aligned to each other in such a manner that they are located on the corners of a diamond, whereas the first guide section is opposite of the second guide section and the third guide section is opposite of the fourth guide section. Preferably, the third and the fourth guide sections, in particular preferably the first and the second guide sections as well, possess lateral guide elements; the mutual distance of the guide elements to each other is adjustable. For this purpose, in turn, at least one, preferably two, guide elements of each guide section are movably mounted and can be fixed in the respective desired position. It is particularly advantageous if the respective guide elements are mounted in a displaceable manner perpendicular to a predetermined direction of fiber sliver transport of the sliver guide, in order to (laterally) limit the area to be passed by the fiber slivers in its width running perpendicular to the direction of fiber sliver transport.

It is particularly advantageous if at least two of the guide sections run parallel to each other, whereas it is particularly advantageous if all of the guide sections run parallel to each other, in order to guide the fiber slivers in a linear transport direction (whereas the guide sections preferably are to extend parallel to each other and perpendicular to the predetermined transport direction of the sliver guide). In each case, the longitudinal extension of the guide sections also preferably runs perpendicular to the predetermined direction of fiber transport of the sliver guide. Preferably, in a top view of the sliver guide, the guide sections are formed as connecting sections of two side walls preferably extending in the specified direction of fiber transport, whereas the connection between the side walls and the individual guide sections or components featuring the guide sections may be formed in a detachable manner. In addition, the side walls or other wall sections of the sliver guide may be provided with one or more mounts, for example in the form of brackets, pins or other elements, through which the sliver guide can be connected to a draw frame.

It is also advantageous if at least one of the guide sections is formed by a surface section of an elongated guide rod that is mounted on one side or both sides. The guide rod may be formed, for example, as circular, lenticular or in oval shape in a cross section. In addition, it is advantageous if all of the guide sections are formed by surface sections of separate guide rods that in turn preferably extend parallel to each other. Moreover, it is advantageous if the respective guide rods are respectively mounted on both sides in two side walls of the sliver guide, which in particular run parallel to each other, whereas the mounting is preferably realized in a detachable manner, for example by means of screw connection. In addition, the side walls are preferably to run perpendicular to the longitudinal axes of the guide rods and parallel to the direction of fiber sliver transport of the sliver guide.

It is also highly advantageous if at least one guide element is in a positive-locking connection with a guide rod and can be displaced in the longitudinal direction of the guide rod. Through the displacement of one or two adjacent guide elements of a guide section, ultimately, the mutual distance of the guide elements and thus the width of the area of the corresponding guide section to be passed by the respective fiber slivers can be specified. The respective guide element may comprise, for example, a recess or an indentation, through which it can interact in a positive-locking manner with an indentation or a recess of the guide section allocated to it.

It is also advantageous if at least one guide element comprises a fixing device, with the assistance of which it can be fixed with respect to the guide rod. Thereby, the position of the respective guide element can be securely maintained after adjusting its distance to the adjacent guide element. The fixing device may comprise, for example, a screw or a threaded pin, which sits in a thread of the guide element and is pressed against a guide section upon tightening. Likewise, various clamping mechanisms are possible, such that the corresponding guide element may be preferably fixed by means of frictional connection at a defined point of a guide section.

It is also advantageous if at least one guide element is formed by an eccentrically arranged eccentric disk featuring an eccentric through hole, whereas the through hole is preferably penetrated by the guide rod and the eccentric disk need not necessarily be round. The eccentric disks, of which it is preferable that two are present for each guide rod, may be displaced in the longitudinal direction of the guide rod after releasing a corresponding fixing device, such that their mutual distance can be shifted and thus adjusted easily and quickly. In addition, by rotating the respective eccentric disk around its axis of rotation running through the through hole, there can be a determination of the direction in which the major part of the eccentric disk is to extend, in order to adapt the guide element formed by the eccentric disk optimally to the fiber slivers to be drafted.

Furthermore, it is advantageous if at least one guide element is pivotable around a pivot axis. For example, it would be conceivable to form the guide elements in plate or paddle shapes, whereas one or more side edges may be rounded. In turn, the corresponding guide elements could be connected, preferably eccentrically, through a pivot axis with one of the guide sections, whereas, through the pivoting of one or more guide elements of a guide section, their mutual spacing and thus the passage width for the fiber slivers would be adjustable. The respective pivot axis preferably extends perpendicular to the direction of fiber sliver transport of the sliver guide. In addition, in this case as well, a corresponding fixing device is to be present in order to fix the respective guide element after pivoting with respect to the pivot axis.

It is also advantageous if at least one of the specified guide sections features, in the direction of its longitudinal axis, one or more intermediate guides, with the assistance of which several fiber slivers can be guided in a manner laterally spaced to each other. The intermediate guides are spaced apart from each other in the direction of the specified longitudinal axis, such that, in each case, a fiber sliver can be guided between two intermediate guides, or one intermediate guide and one adjacent lateral guide element. In particular, it is advantageous if the first and the second guide sections are provided with corresponding intermediate guides, whereas the intermediate guides of the two guide sections are to be arranged in a manner offset to each other in the direction of the longitudinal extension of the guide sections. This ultimately ensures that the fiber slivers are guided by the two guide sections in such a manner that, after leaving the guide sections or entering the area of the third guide section, they partially run over each other and are thereby overlaid.

It is also advantageous if at least one intermediate guide can be displaced in the direction of a longitudinal axis of the guide section featuring the intermediate guides. In this manner, the distances between the individual intermediate guides can be adjusted to the respective fiber slivers to be drafted. In this case, fixing devices are also to be allocated to the intermediate guides, in order to fix their position. Incidentally, the intermediate guides may be formed by ring disks, which can be inserted through a through hole to a corresponding guide rod and subsequently fixed.

Furthermore, a draw frame that incorporates the previously described invention is proposed. It is thus provided that, in addition to a first and a second guide section, in an entrance area upstream of the drafting unit of the draw frame, a third guide section for fiber slivers is arranged, which, in a side view of the draw frame, is spaced apart from the first and second guide sections, whereas lateral guide elements are allocated to at least one of the guide sections for the lateral guidance of fiber slivers; the mutual distance of the guide elements is adjustable. Advantageously, in the specified side view, the first and the second guide sections are spaced apart from each other, both vertically and horizontally. In addition, the third guide section is to be adjacent to the entry rollers of the drafting unit, such that the fiber slivers leaving the guide sections can enter directly into the drafting unit.

It is additionally advantageous if, in the specified entrance area, a fourth guide section is arranged, which, in the specified side view, is spaced apart from the first guide section, the second guide section and the third guide section, whereas it is preferable that lateral guide elements are likewise allocated to the fourth guide section for the lateral guidance of fiber slivers; the mutual distance of the guide elements can also be adjustable. The fourth guide section is preferably arranged upstream of the remaining guide sections in the transport direction of the drafting unit, and serves the purpose of guiding the fiber slivers upon entering the guide area of the draw frame formed by the guide sections. In addition, in the side view of the draw frame, the first and second guide sections are to be arranged one above the other (possibly with a slight mutual lateral offset), such that a first group of the fiber slivers fed to the draw frame can be guided over the first guide section and a second group of fiber slivers can be guided below the second guide section.

If the draw frame is a so-called "double-head draw frame" with two drafting units, it is advantageous in other respects if a separate fiber sliver guide with the described guide sections is allocated to each drafting unit.

It is particularly advantageous if the guide section is formed by a sliver guide in accordance with the previous or following description, whereas the sliver guide is preferably detachably connected to a holding section of the draw frame. Herein, individual characteristics described in connection with the sliver guides or shown in the figures may be realized individually or in any combination, to the extent that the individual characteristics are not in conflict with each other.

It is advantageous if the first guide section, the second guide section, the third guide section and/or the fourth guide section are aligned horizontally and/or perpendicular to a transport direction of the drafting unit. The fiber slivers ultimately pass through the individual guide sections, above or below them.

BRIEF DESCRIPTION OF THE DRAWINGS

Further advantages of the invention are described in the following embodiments. The following is shown.

DETAILED DESCRIPTION

Figure 1:
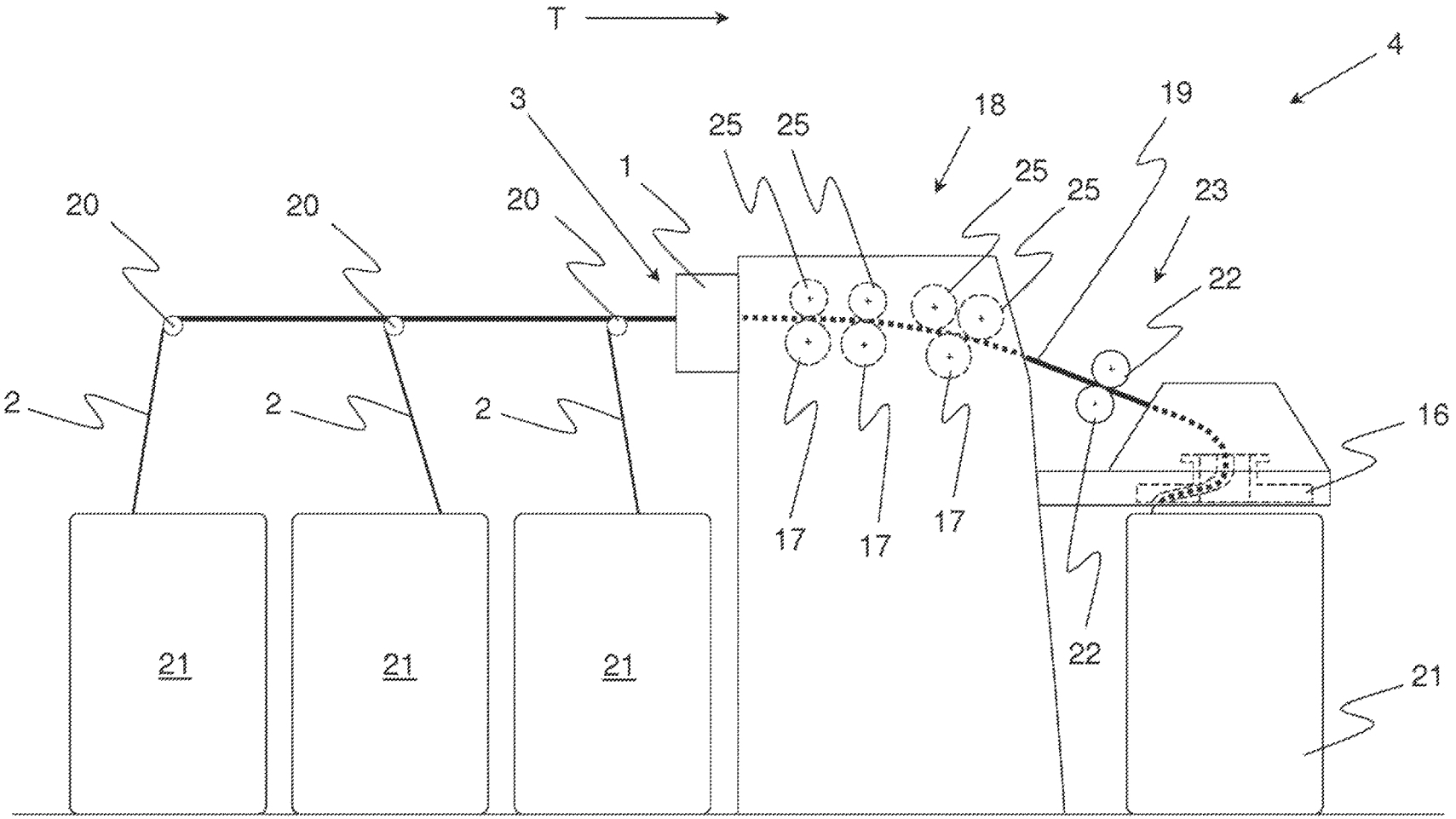
FIG. 1 is a side view of a draw frame.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a side view of a draw frame 4 for drafting (making uniform) several fiber slivers 2. During the operation of the draw frame 4, the fiber slivers 2 are taken from one or more so-called "spinning cans" 21, and are fed via corresponding deflection devices 20 and a sliver guide 1 to the drafting unit 18 of the draw frame 4 (or in the case of a multi-head draw frame: the drafting units 18 of the draw frame 4).

The drafting unit or each of the drafting units 18 typically includes three or more roller assemblies, each of which may feature at least one bottom roller 17 and one or more top rollers 25. The desired drafting of the fiber assembly consisting of the individual fiber slivers 2 finally arises from the fact that the individual cylindrical bottom rollers 17, and thus also the individual top rollers 25 in contact with them have a progressively greater peripheral speed in the shown transport direction T of the drafting unit 18. While other solutions are also possible, in the embodiments shown, the drafting unit 18 has bottom rollers 17 in the form of an entry cylinder, a medium cylinder and an output cylinder (viewed in the transport direction, arranged one after the other). The individual cylinders are in turn in contact with one or more opposing cylinders formed by the top rollers 25, such that the fiber assembly may be guided by clamping. Given the peripheral speeds of the specified cylinder increasing in the transport direction, the drafting and thus the fiber assembly is finally made uniform.

Following the drafting unit 18, the drafted fiber material (=fiber web 19) is typically conducted through a condenser (not shown), which is preferably formed as a web funnel and brings about a condensing of the fiber web 19.

Subsequently, the fiber web 19 arrives in the area of a draw-off device 23, which typically comprises a multiple number of rotatable or at least partially driven draw-off elements, for example in the form of two draw-off disks 22 contacting the fiber web 19 from two sides. Through a correspondingly high conveying speed, the draw-off device 23 brings about a further draft of the fiber web 19. Finally, the fiber web 19 is typically fed to a rotating rotary plate 16 and is stored by this in the form of a loop in a provided spinning can 21.

As already mentioned, the individual fiber slivers 2 are typically guided by means of a sliver guide 1 arranged in the entrance area 3 of the drafting unit 18. For this purpose, the known sliver guides 1 usually have a multiple number of rods running in parallel to each other and vertically, between which the individual fiber slivers 2 are guided.

However, if one of the fiber slivers 2 has a certain property (thickness, composition, fiber length, etc.) that is different from the corresponding property of the other fiber slivers 2, in the drawn fiber web 19, this lack of quality usually can still be seen in the fact that the homogeneity of the same deviates from a desired target value.

Figure 2:
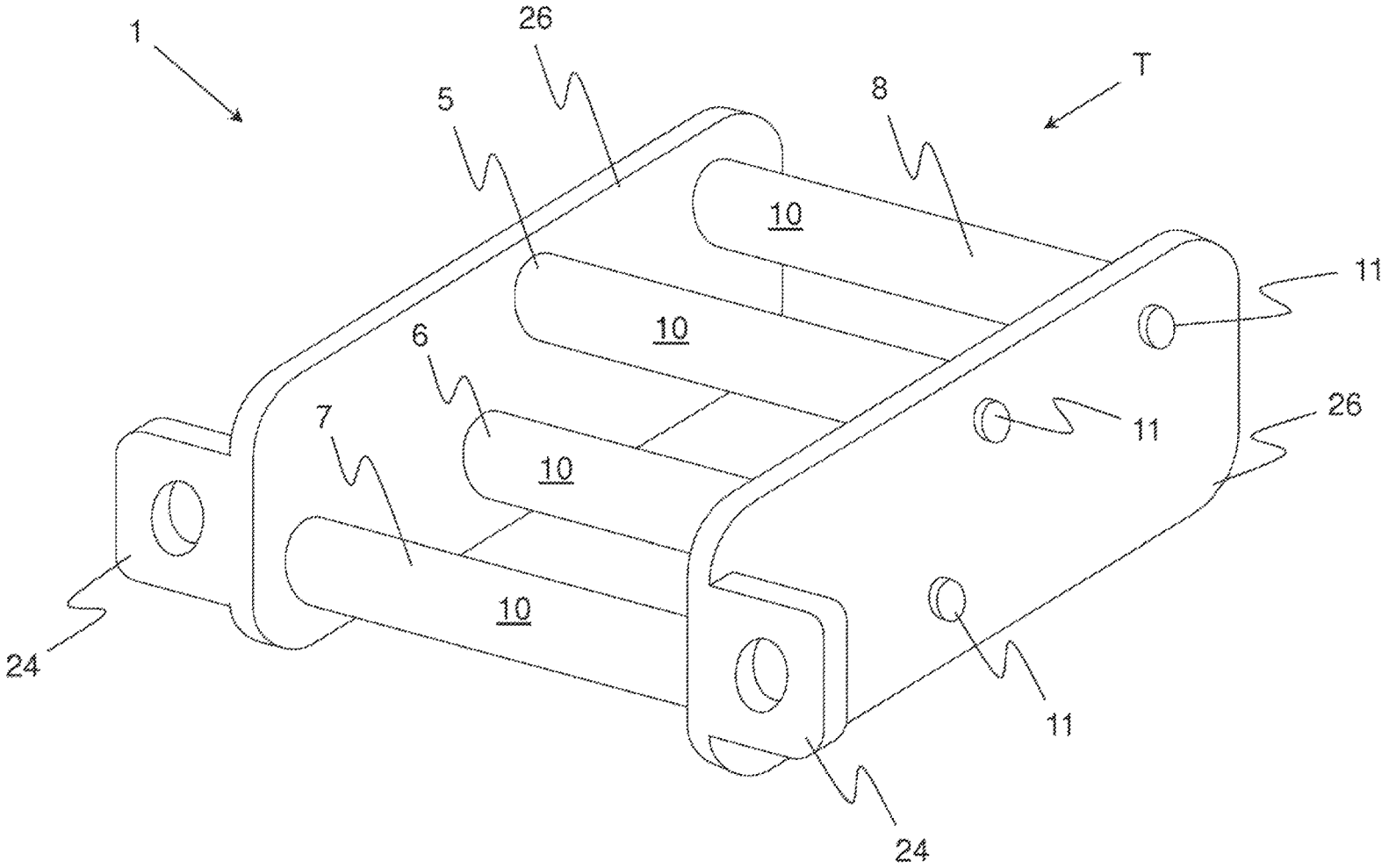
FIG. 2 is a perspective of a sliver guide in accordance with the invention.
Figure 3:
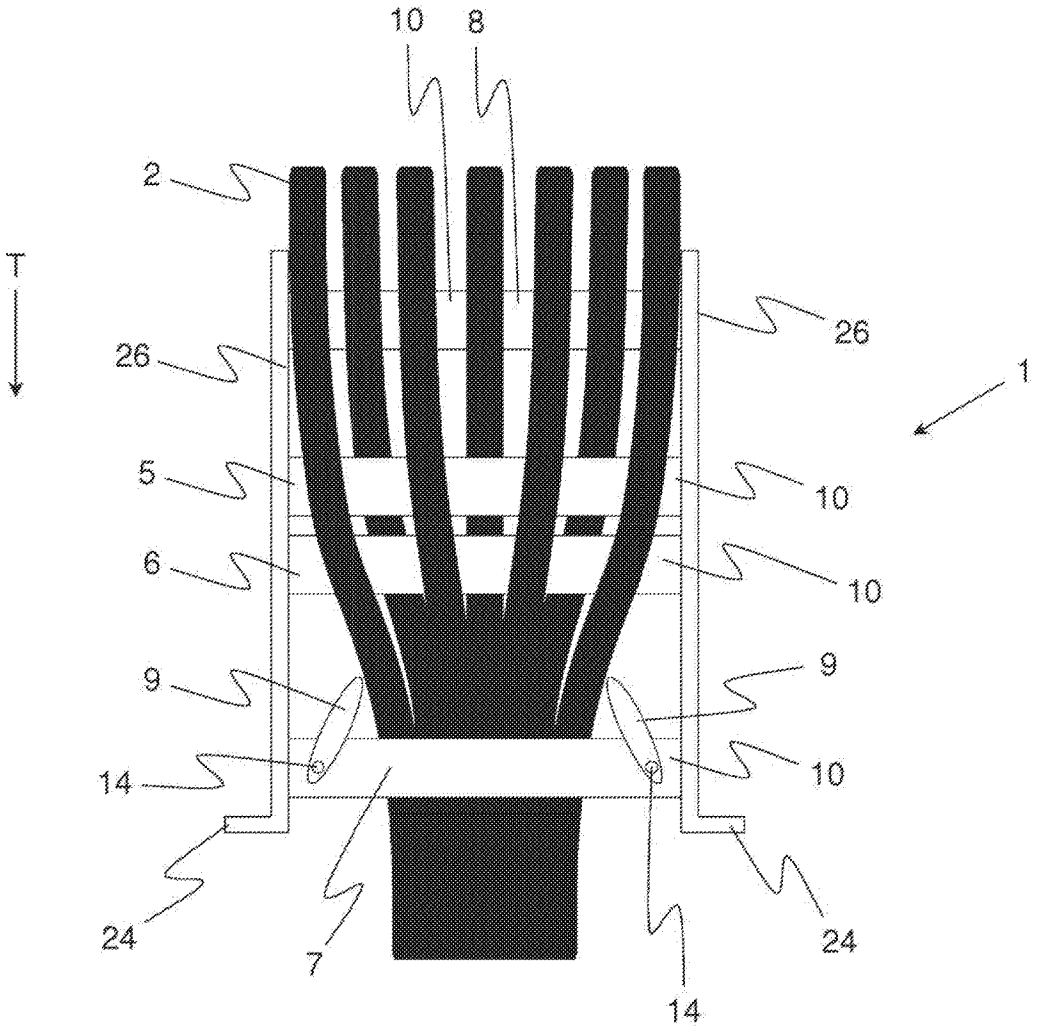
FIG. 3 is a top view of a sliver guide in accordance with the invention.
Figure 4:
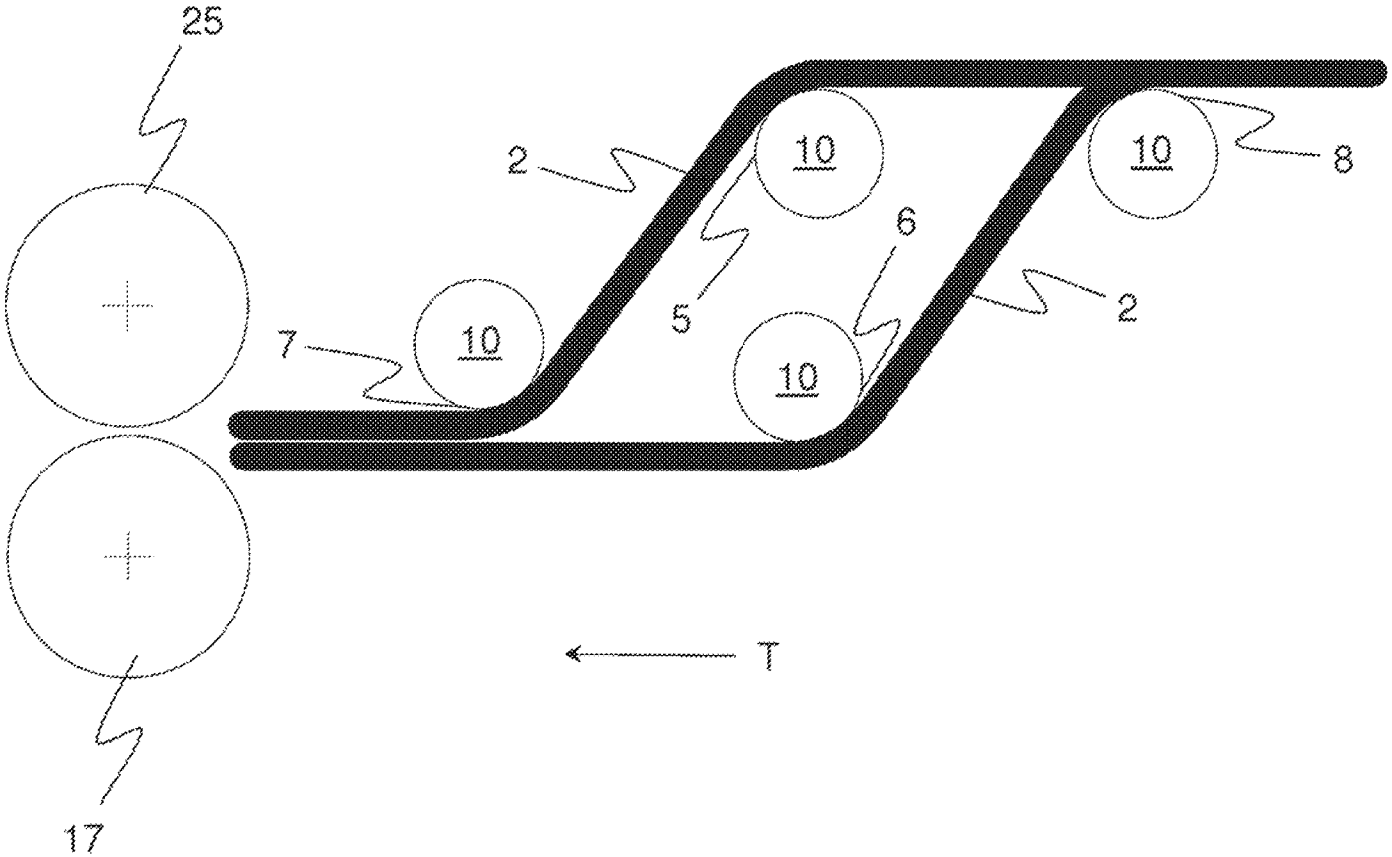
FIG. 4 is a side view of a section of a sliver guide in accordance with the invention in the entrance area of a drafting unit.
Figure 5:
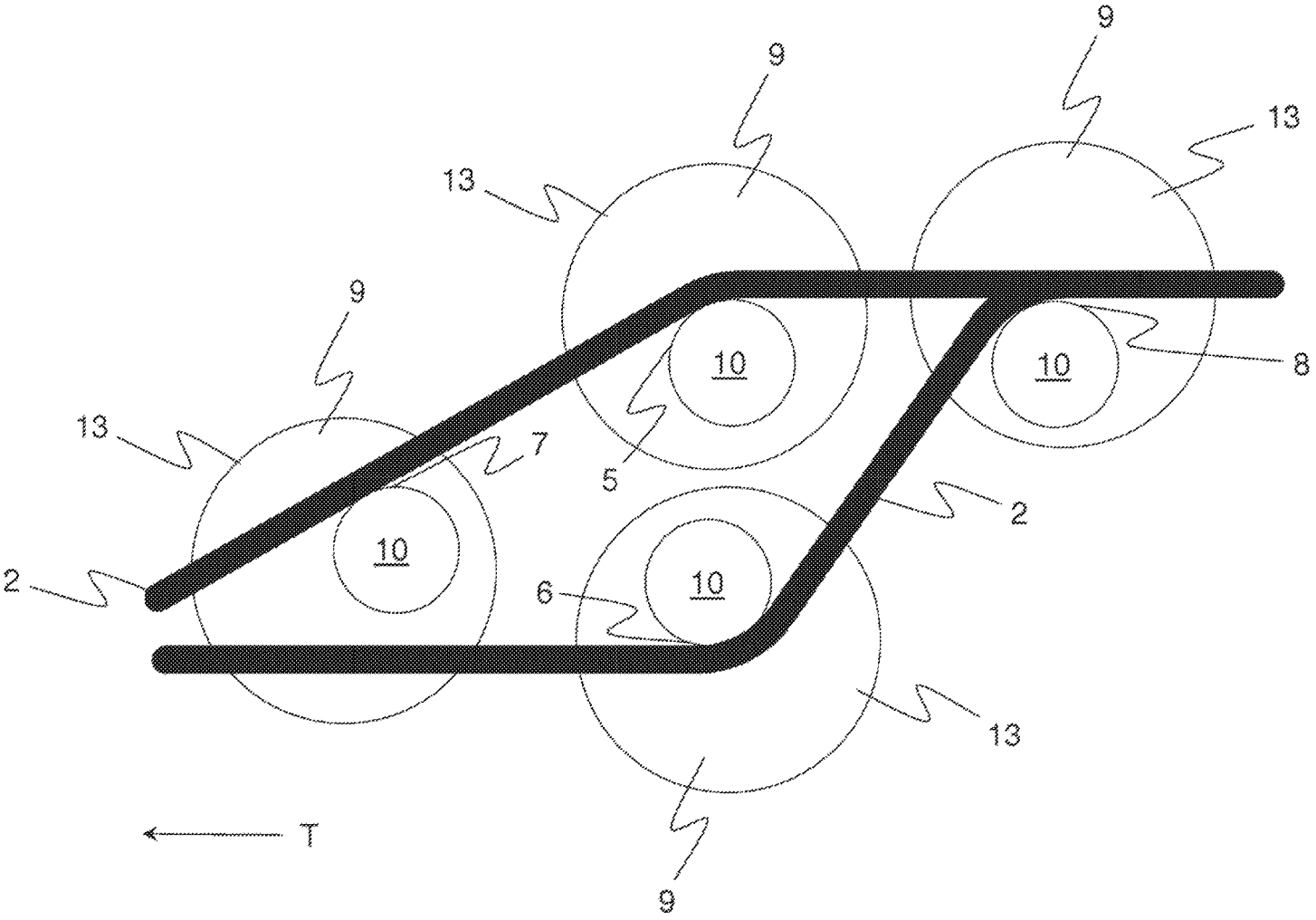
FIG. 5 is a side view of a section of an alternative sliver guide in accordance with the invention.
Figure 6:
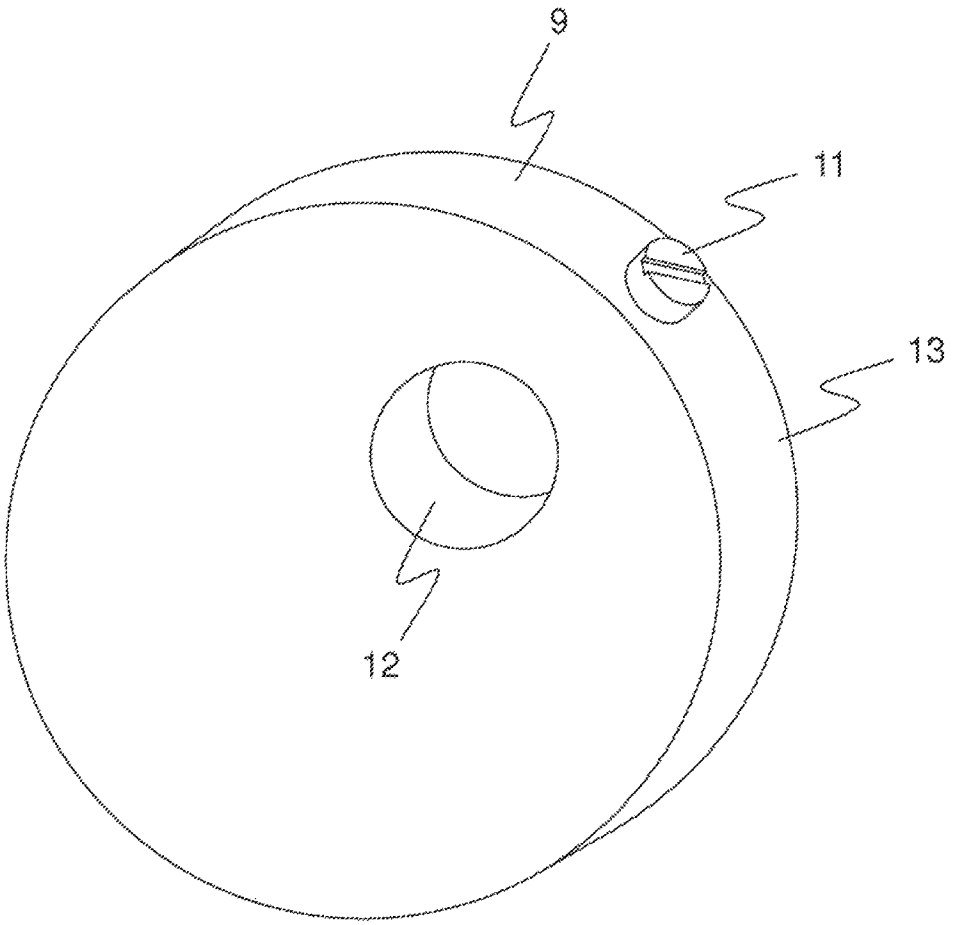
FIG. 6 is a guide element for a sliver guide in accordance with the invention.
Figure 7:
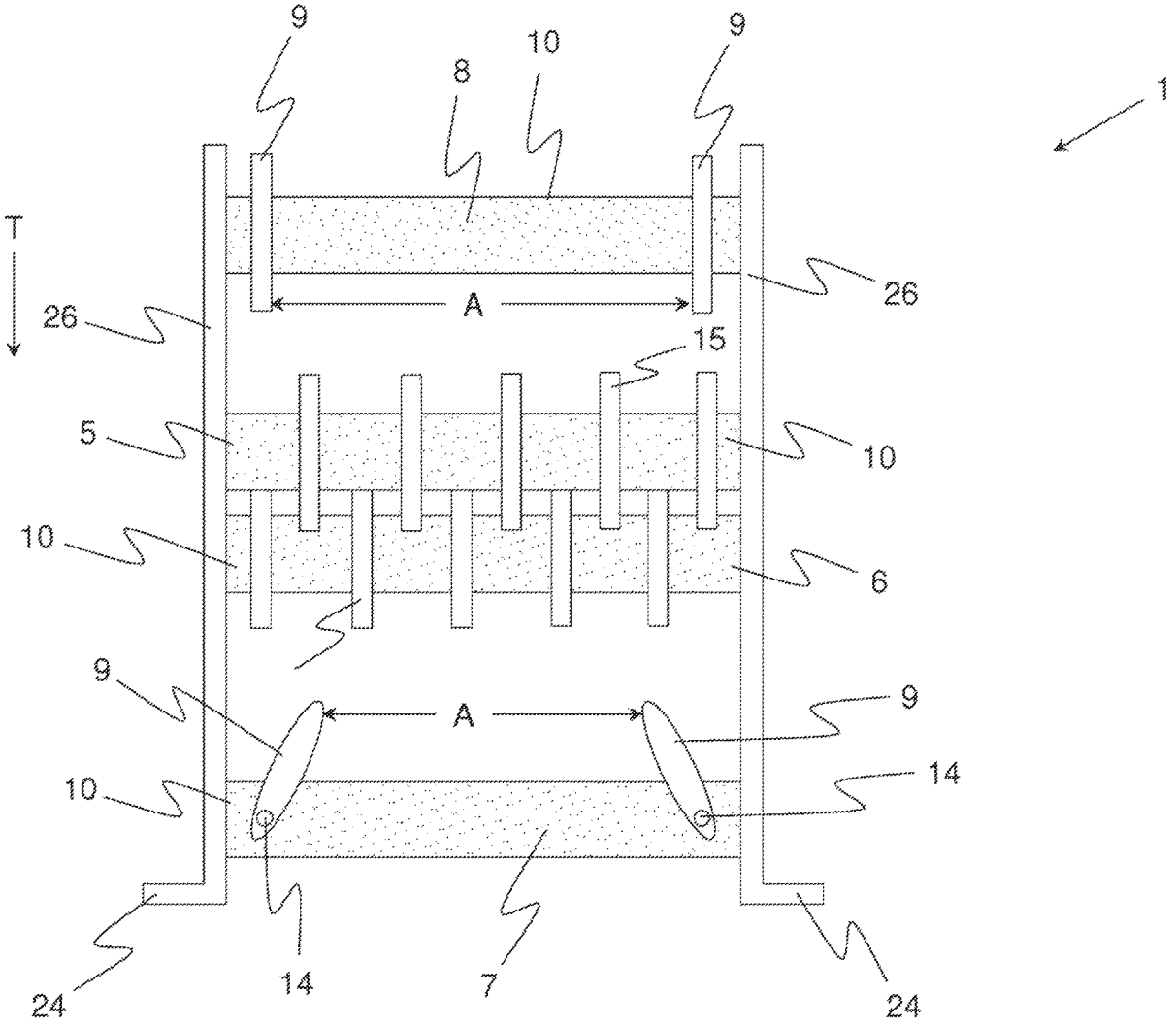
FIG. 7 is a top view of an additional sliver guide in accordance with the invention.

In order to counter this disadvantage, the present invention proposes a new sliver guide 1, as is shown for example in FIGS. 2, 3 and 7 (details of the same shown in FIGS. 4 to 6).

In principle, the sliver guide 1 in accordance with the invention comprises at least three, preferably four (as is shown), guide sections 5, 6, 7, 8, which, in different manners, serve the purpose of guiding individual or all fiber slivers 2 fed to the drafting unit 18, whereas the drafting unit 18, with reference to FIG. 2, would be located at the bottom left, and the sliver guide 1 may be connected, for example, through the shown mounts 24 to a corresponding connection of the draw frame 4 in such a manner that the fiber slivers 2, after leaving the sliver guide 1, may directly enter the drafting unit 18, or between the two entry rollers (shown on the left in FIG. 1).

As can now be seen in FIGS. 3 (top view) and 4 (principle course of the individual fiber slivers 2 in a side view of the sliver guide 1 shown only schematically), the fiber slivers 2, which, viewed in the transport direction, are preferably initially guided with the use of the fourth guide section 8, are divided into two groups (alternatively, the fourth guide section 8 can be dispensed with, whereas, in this case, after passing the deflection devices 20 shown in FIG. 1, the fiber slivers 2 would be split into the first and second guide sections 5, 6).

As can be seen in this connection from FIG. 4, the first group of fiber slivers 2 may rest on the first guide section 5 through its underside, while the fiber slivers 2 of a second group may abut from below at the second guide section 6 and are thus also guided at least in the vertical direction.

After passing through the first and the second guide sections 5, 6, the fiber slivers 2 ultimately arrive in the area of a third guide section 7 (for this purpose, see also FIG. 3), whereas the individual fiber slivers 2 herein are at least partially overlaid (this is indicated in FIG. 4 by the distance of the fiber slivers 2 between the third guide section 7 and the entry rollers assembly of the drafting unit 18 following in the transport direction T). Herein, a mixing of the individual fiber slivers 2 arises in front of the entrance into the drafting unit 18, such that differences in quality may have less strong effects on the fiber web 19 leaving the drafting unit 18.

Of course, the course of the fiber slivers 2 that is shown is only meant to be used as an example. It would also be conceivable, for example, to guide the fibers in accordance with FIG. 5, whereas, in such a case, the third guide section 7 is passed by the first group of the fiber slivers 2 at the top and by the second group of fiber slivers 2 at the bottom.

At this point, it is also to be noted, in general for the entire disclosure, that the invention is not limited to distributing the fiber slivers 2 to two guide sections. Rather, it would also be possible to provide additional guide sections, in addition to the specified first and second guide sections 5, 6, such that the fiber slivers 2 could be divided, for example, among three or four groups, before they are once again united in the area of the guide section 7 designated as the "third guide section" within the framework of the previous description, and are thereby overlaid.

In general, however, it is essential to the invention that two lateral guide elements 9 for the fiber slivers 2 to be guided are allocated to at least one of the guide sections 5, 6, 7, 8, whereas the distance A of the guide elements 9 is adjustable (preferably through the movement of one or both guide elements 9). As can be seen in this connection, for example from FIG. 3, the guide elements 9 serve the purpose of the lateral guidance of the fiber slivers 2 and thus the setting of the width of the guide area to be passed through by the fiber slivers 2. Depending on the type, number and thickness of the fiber slivers 2 to be drafted, the specified width may finally be adjusted by moving one or both guide elements 9, such that it is always ensured that the fiber slivers 2 at least partially overlay each other in the area of the third guide section 7.

As can be inferred, for example, from FIG. 2 (with which the guide elements 9 are not shown for reasons of clarity), the individual guide sections 5, 6, 7, 8 are preferably realized by separate guide elements 9, in particular in the form of, for example, guide rods 10 fixed on both sides with respect to the corresponding side walls. In cross-section, the guide rods 10 may be, for example, round, oval or in teardrop shape, and, with the assistance of fixing devices 11 (such as screws), may be detachably connected to the side walls 26 of the sliver guide 1.

Further, it is conceivable that intermediate guides 15 are present in the area of the individual guide sections 5, 6, 7, 8, preferably in the area of the first and the second guide sections 5, 6. These may be formed, for example, by ring disks, which are mounted (for example, detachably) on the specified guide rods 10, and, with their assistance, the individual fiber slivers 2 may be guided in a manner separated from each other (compare FIG. 7). The intermediate guides 15 of the individual guide sections 5, 6, 7, 8 can also be offset from each other in the width direction of the sliver guide 1 (i.e., perpendicular to the transport direction T), resulting in a highly reliable superimposition of the individual fiber slivers 2 in the area of the third guide section 7.

As FIGS. 3 and 7 also show, the guide elements 9 may be attached directly to a guide rod 10 featuring a guide section 5, 6, 7, 8, and it is conceivable, for example, to form the respective guide element 9 in a paddle shape and to realize the attachment to the guide bar 10 with the assistance of a pivot axis 14, such that, by pivoting the guide element(s) 9, their mutual distance A may also be adjusted.

Alternatively, the guide elements 9 may also be formed by eccentric disks 13 shown in FIGS. 5 to 7, which are preferably inserted through a through hole 12 to the respective guide rod 10 and, for example, may be fixed with a fixing device 11 (screw, threaded bolt, or the like) to the intended position. By rotating the eccentric disks 13, the lateral guidance of the fiber slivers 2 may ultimately be adjusted if necessary (see FIG. 5, in which the eccentric disks 13 are aligned differently; incidentally, in FIG. 5, only guide elements 9 arranged behind the sheet level are shown, in order to enable a view of the fiber slivers 2).

This invention is not limited to the illustrated and described embodiments. Variations within the framework of the claims are also possible, such as any combination of the described characteristics, even if they are illustrated and described in different parts of the description or the claims or in different embodiments. For example, the individual guide sections need not all be part of a sliver guide detachably connectable with the draw frame. Rather, the individual guide sections may be attached independently of each other to a support or a frame of the draw frame.

REFERENCE SIGNS

1 Sliver guide
2 Fiber sliver
3 Entrance area
4 Draw frame
5 First guide section
6 Second guide section
7 Third guide section
8 Fourth guide section
9 Guide element
10 Guide rod
11 Fixing device
12 Through hole
13 Eccentric disk
14 Pivot axis
15 Intermediate guide

16 Rotary plate
17 Bottom roller
18 Drafting unit
19 Fiber web
20 Deflection device
21 Spinning can
22 Draw-off disk
23 Draw-off device
24 Mount
25 Top roller
26 Side wall
A Distance
T Transport direction of the drafting unit

The invention claimed is:

1. A sliver guide for guiding a multiple number of fiber slivers in an entrance area of a draw frame, comprising:
a first guide section disposed to guide a first group of fiber slivers;
a second guide section disposed to separately guide a second group of fiber slivers;
in a side view of the sliver guide, the first guide section and the second guide section spaced apart from each other in one or both of a vertical direction or a transport direction of the fiber slivers through the sliver guide;
a third guide section spaced apart from the first guide section and the second guide section in the side view in one or both of the vertical direction or the transport direction of the fiber slivers through the sliver guide;
first lateral guide elements configured with at least one of the guide sections, wherein a lateral distance between the first lateral guide elements is adjustable.

2. A sliver guide for guiding a multiple number of fiber slivers in an entrance area of a draw frame, comprising:
a first guide section disposed to guide a first group of fiber slivers;
a second guide section disposed to separately guide a second group of fiber slivers;
in a side view of the sliver guide, the first guide section and the second guide section spaced apart from each other;
a third guide section spaced apart from the first guide section and the second guide section in the side view;
first lateral guide elements configured with at least one of the guide sections, wherein a lateral distance between the first lateral guide elements is adjustable; and
further comprising a fourth guide section spaced apart from the first, second, and third guide sections in the side view, and second lateral guide elements configured with the fourth guide section, wherein a lateral distance between the second lateral guide elements is adjustable.

3. The sliver guide in accordance with claim 1, wherein at least two of the guide sections run parallel to each other.

4. A sliver guide for guiding a multiple number of fiber slivers in an entrance area of a draw frame, comprising:
a first guide section disposed to guide a first group of fiber slivers;
a second guide section disposed to separately guide a second group of fiber slivers;
in a side view of the sliver guide, the first guide section and the second guide section spaced apart from each other;
a third guide section spaced apart from the first guide section and the second guide section in the side view;
first lateral guide elements configured with at least one of the guide sections, wherein a lateral distance between the first lateral guide elements is adjustable; and
wherein at least one of the guide sections comprises an elongated rod mounted on one side or both sides thereof.

5. The sliver guide in accordance with claim 4, wherein at least one of the first lateral guide elements is adjustable in position relative to the elongated rod.

6. The sliver guide in accordance with claim 5, further comprising a fixing device that releasably fixes the lateral guide element in position along the elongated rod.

7. The sliver guide in accordance with claim 5, wherein the lateral guide element comprises an eccentric disk with a through hole, the elongated rod passing through the through hole.

8. The sliver guide in accordance with claim 5, the lateral guide element pivotal at a pivot axis relative to the elongated rod.

9. The sliver guide in accordance with claim 2, wherein any one or combination of the first through fourth guide sections further comprises one or more longitudinally spaced intermediate guides that guide laterally spaced fiber slivers moving over the respective guide section.

10. The sliver guide in accordance with claim 9, wherein the intermediate guides are adjustable along a longitudinal axis of the respective guide section.

11. A draw frame, comprising:
an entrance area for fiber slivers to be drafted;
a drafting unit comprising a plurality of drafting unit rollers;
a sliver guide section at the entrance area, the sliver guide section further comprising
a first guide section disposed to guide a first group of fiber slivers;
a second guide section disposed to separately guide a second group of fiber slivers;
in a side view of the sliver guide, the first guide section and the second guide section spaced apart from each other in one or both of a vertical direction or a transport direction of the fiber slivers through the sliver guide;
a third guide section spaced apart from the first guide section and the second guide section in the side view in one or both of the vertical direction or the transport direction of the fiber slivers through the sliver guide;
first lateral guide elements configured with at least one of the guide sections, wherein a lateral distance between the first lateral guide elements is adjustable.

12. A draw frame, comprising:
an entrance area for fiber slivers to be drafted;
a drafting unit comprising a plurality of drafting unit rollers;
a sliver guide section at the entrance area, the sliver guide section further comprising
a first guide section disposed to guide a first group of fiber slivers;
a second guide section disposed to separately guide a second group of fiber slivers;
in a side view of the sliver guide, the first guide section and the second guide section spaced apart from each other;
a third guide section spaced apart from the first guide section and the second guide section in the side view;
first lateral guide elements configured with at least one of the guide sections, wherein a lateral distance between the first lateral guide elements is adjustable; and
wherein the sliver guide further comprises a fourth guide section spaced apart from the first, second, and third guide sections in the side view, and second lateral guide elements configured with the fourth guide section, wherein a lateral distance between the second lateral guide elements is adjustable.

13. The draw frame in accordance with claim 12, wherein the first through fourth guide sections are aligned horizontally or perpendicular to a transport direction of the fiber slivers through the drafting unit.

* * * * *